United States Patent [19]

Henninger

[11] Patent Number: 4,604,505

[45] Date of Patent: Aug. 5, 1986

[54] SWITCH-PLUG INTERLOCK

[75] Inventor: William H. Henninger, Paramus, N.J.

[73] Assignee: ERO, Inc., Glasser, N.J.

[21] Appl. No.: 735,274

[22] Filed: May 17, 1985

[51] Int. Cl.[4] ..... H01H 9/20

[52] U.S. Cl. ..... 200/50 B

[58] Field of Search ..... 200/50 R, 50 B, 51.09, 200/51.1

[56] References Cited

U.S. PATENT DOCUMENTS

| | | | |
|---|---|---|---|
| 1,818,290 | 8/1931 | Wulle | 200/50 B |
| 1,924,691 | 8/1933 | Lofgren | 200/50 B |
| 1,934,024 | 11/1933 | Anderson | 200/50 B |
| 1,971,990 | 8/1934 | Reynolds et al. | 200/50 B |
| 2,015,543 | 9/1935 | Bissell | 200/50 B |
| 2,241,828 | 5/1941 | Reynolds | 200/50 B |
| 2,397,595 | 4/1946 | Conlan | 200/50 B |
| 2,441,465 | 5/1948 | Bauroth | 200/50 B |
| 2,470,944 | 5/1949 | Parish | 200/50 B |
| 4,335,286 | 6/1982 | Nelson | 200/50 B X |
| 4,503,293 | 3/1985 | Knecht | 200/50 B |

*Primary Examiner*—J. R. Scott

*Attorney, Agent, or Firm*—Thomas Adams

[57] ABSTRACT

A receptacle for receiving a plug includes a frame and an electrical connector mounted on the frame. A switch is electrically connected to the connector and can disconnect it. A manually operable interlock has an on and off position. This interlock is mounted on the frame for operating the switch to apply power to the connector after the securing of the plug into the connector. The interlock has a grasping device for grasping the plug on a rearward external surface of the plug. The grasping device prevents the removal of the plug in response to the interlock being placed in the on position.

9 Claims, 5 Drawing Figures

SWITCH-PLUG INTERLOCK

BACKGROUND OF THE INVENTION

The present invention relates to electrical receptacles with interlocks for keeping power off the connector when it is being inserted and withdrawn, and, in particular, to devices for grasping the plug and preventing removal when power is being conveyed through the plug.

In the many applications for electrical connectors for power cables, safety is always important. An important safety consideration is removing power from the connector when it is being inserted or withdrawn. Such a precaution prevents dangerous arcing then and can reduce contact life as well. An early approach to solving this problem (U.S. Pat. No. 3,598,941) involved placing a spring loaded slider within a receptacle. Withdrawal of a plug from this special receptacle caused the slider to move thereby simultaneously operating a circuit breaker and removing power from the special receptacle. However, this receptacle made no attempt to physically disconnect power while retaining the plug engaged with the connector. Moreover, the mechanism was strictly internal and involved a modification to the conventional connector structure.

U.S. Pat. No. 4,335,286 concerns a plug/connector combination that may be locked together by a pin and hole assembly. However, this device requires using a non-standard connector and plug. U.S. Pat. No. 4,414,440 shows an interlock having moving components external to the connector. However, this interlock again makes no attempt to physically prevent plug removal when power is flowing.

Accordingly, there is a need for a device that will prevent application of power before a plug is inserted into a receptacle and will physically prevent removal of a plug from a receptacle when power is flowing through the receptacle.

SUMMARY OF THE INVENTION

In accordance with the illustrative embodiment demonstrating features and advantages of the present invention, there is provided a receptacle having an electrical connector mounted on a frame. A switch means is electrically connected to the connector and can operate to disconnect the connector. Included is a manually operable interlock means having an on and off position. This interlock means is mounted on the frame for operating the switch means. This interlock means is supported on the frame for operating the switch means to apply power to the connector after the securing of the plug into the connector. The interlock means includes a grasping means. The grasping means can grasp the plug on a rearward external surface thereof and prevent its removal, in response to the interlock means being placed in the on position.

By employing apparatus of the foregoing type, an improved receptacle is achieved. In the preferred embodiment a handle can operate a circuit breaker that removes power from a connector. This handle also operates a cam structured as a cam slot. The cam slot can raise and lower a grasping arm to hold from behind the locking collar on a plug. This feature prevents plug removal when power is flowing.

This preferred embodiment also employs a slider mounted on the outside of the connector. When the plug is secured to the connector by threading the locking collar, the slider is pushed inwardly. When pushed inwardly, a boss on the slider moves away from a step on a pivotally mounted grasping arm. This shift then allows the arm to move downwardly as the handle is driven inward, thereby simultaneously applying power to the connector and grasping the plug from behind.

Therefore, not only is power application possible only when the plug is inserted, but plug removal is positively prevented by the capture device. The foregoing does not require modification to a standard plug. This feature is important in that any standard plug can be now inserted into this receptacle.

BRIEF DESCRIPTION OF THE DRAWING

The above brief description as well as other features and advantages of the present invention will be more fully appreciated by reference to the following detailed description of a presently preferred but nonetheless illustrative embodiment in accordance with the present invention when taken in conjunction with the accompanying drawings, wherein.

DETAILED DESCRIPTION OF THE PREFERRED EMBODIMENT

Figure 1:
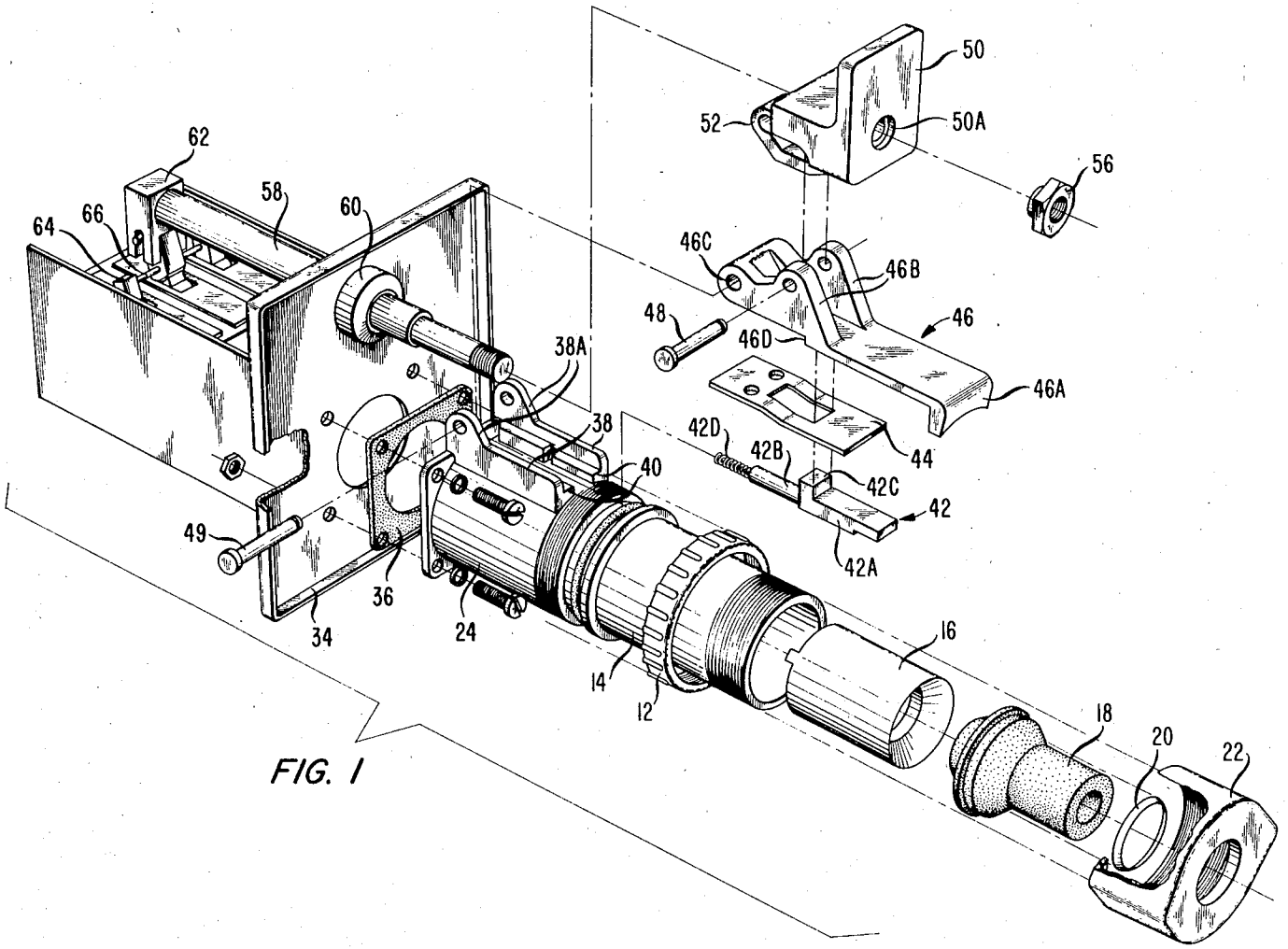
FIG. 1 is an exploded, perspective diagram of the receptacle of the present invention.

Referring to FIGS. 1–5 the illustrated receptacle is designed to cooperate with a plug 10 having a locking collar 12. Plug 10 includes a main body 14 (FIG. 1) into which a sleeve 16 may be inserted. Sleeve 16 has a tapered outer end designed to receive bushing 18. Elements 16 and 18 as well as washer 20 are held in place by an outer locking collar 22. Plug 10 is a standard commercially available plug used to connect electrical power. An example of such a plug is plug 3W4P (250 VAC, 50 A) #534MP, manufactured by Midland-Ross Corp., R&S Div., Mipco Unit, Fairfield, N.J.

Figure 4:
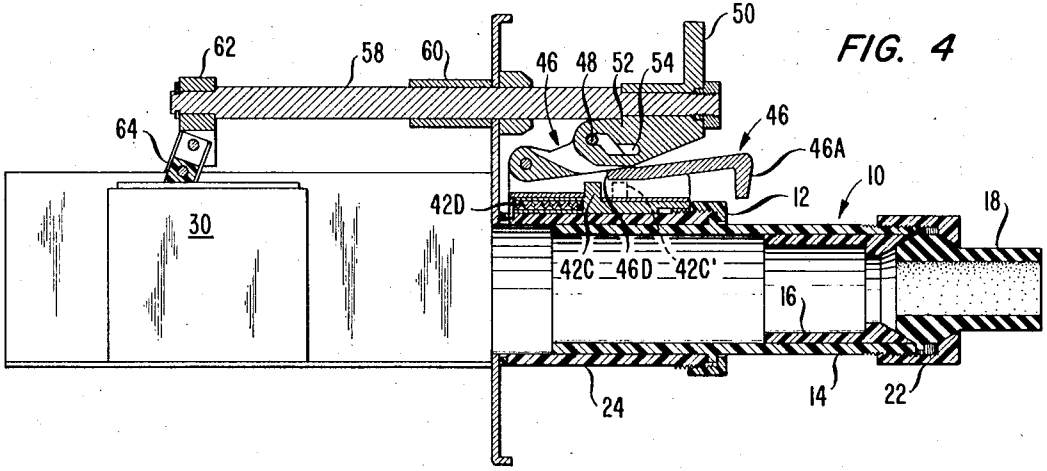
FIG. 4 is a longitudinal, sectional view along lines 4—4 of FIG. 3.
Figure 5:
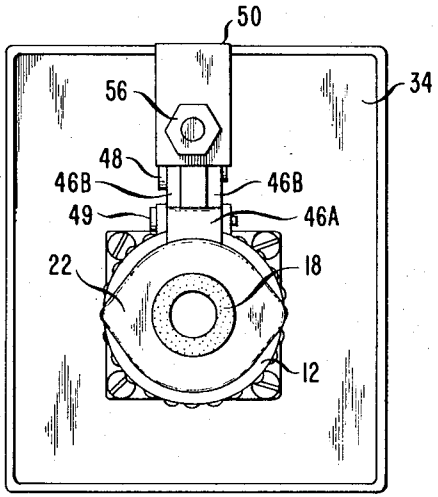
FIG. 5 is an end view of the receptacle of FIG. 2.

Connector 24 includes an outer cylindrical housing having external threads for receiving locking collar 12 (FIG. 4). Mounted inside connector 24 is a female connection assembly 26 (FIG. 3) which may be purchased from the supplier of plug 14. Wires 28 from female connection assembly 26 are routed to switch means 30, in this embodiment a trio of circuit breakers. Ground wire 32 (FIGS. 2 and 3), connects from female connection 26 to the frame 34 on to which connector housing 24 is mounted by the illustrated screws.

Frame 34 is in this embodiment a sheet metal plate having apertures for the connector and other apparatus mounted thereon as described hereinafter. A rubber gasket 36 (FIG. 1) is interposed between frame 34 and connector housing 24. The top portion of connector housing 24 has a recess formed between walls 38. Integral with walls 38 are steps 40, spaced to define a channel. As illustrated, shoulders 40 are enlarged at interior positions.

An interlock means is shown including a slider 42 in the form of a bar 42A connected to a sleeve 42B containing a compression spring 42D. Slider 42 is sized to fit within the channel formed by steps 40, with spring 42D being pressed against the end wall of the channel.

Slider 42 also has a boss 42C, useful for the purposes described hereinafter. Slider 42 is held in place in the channel between steps 40 by a cover plate 44 held in position by screws (not shown). Cover plate 44 has a central rectangular opening (for clearing boss 42C) and has a jog designed to accomodate the increase in the size of steps 40.

Grasping means, shown herein as arm 46, has an inwardly directed tab 46A, a pair of journal walls 46B projecting outwardly from arm 46. Walls 46B have apertures designed to receive cam follower 48. The inner end of arm 46 terminates in journal 46C. The underside of arm 46 includes a step 46D.

Figure 2:
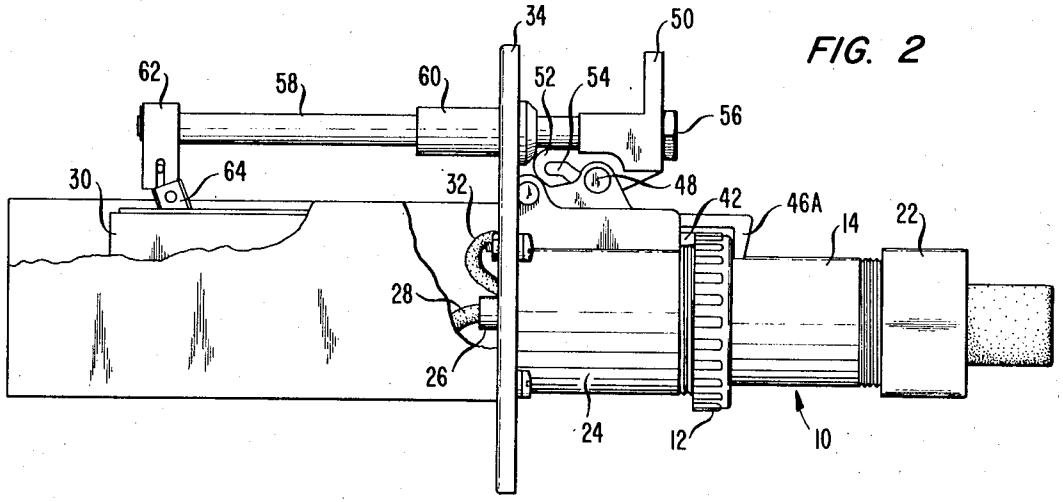
FIG. 2 is an assembled side view of the receptacle of FIG. 1.
Figure 3:
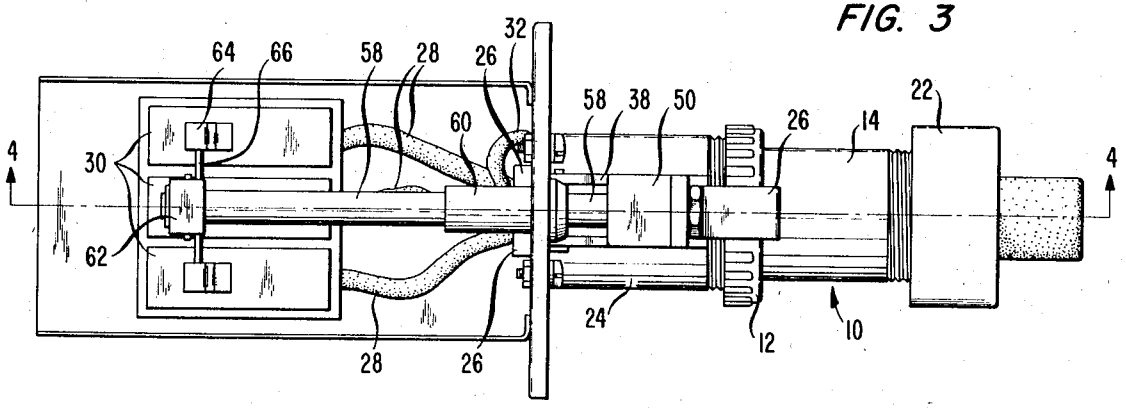
FIG. 3 is a top view of the receptacle of FIG. 2.

Arm 46, by its journal 46C, is pivotally connected to the journalled portions 38A of walls 38 by means of pin 48. It will be noted that arm 46 and its tab 46A are sized to allow tab 46A to grasp the rearward external surface of locking collar 12 (FIG. 2).

The interlock means also includes handle 50 in the form of an L-shaped block having a bore 50A. Integral to and underneath handle 50 is a cam means 52 including a cam slot 54. Cam 52 is in the form of a reduced thickness plate, having its slot 54 diverging downwardly (this view) for longitudinally outward positions. Handle 50 and thus cam 52 are attached by nut 56 to shaft 58, the latter slidably mounted in frame 34 through bushing 60. The inner end of shaft 58 is secured to block 62 whose lower end is pivotally connected to switch levers 64 of circuit breakers 30. The switch levers 64 are joined together by unifying pin 66.

To facilitate an understanding of the principles associated with the foregoing apparatus, its operation will be briefly described. Referring to FIG. 4, the apparatus is shown with handle 50 withdrawn so that circuit breakers 30 have been switched off to remove power from the female connection within connector housing 24. Being thus positioned, cam 52 has lifted pin 48 and thus arm 46 about its pivot. Consequently tab 46A will not interfere with locking collar 12 of plug 10. Accordingly, plug 10 can be inserted or removed by simply loosening or tightening collar 12. Should locking collar 12 be unthreaded, it would no longer engage slider 42. Accordingly, boss 42C will be driven to the phantom position 42C' by the urging of spring 42D (FIGS. 1 and 4). When in position 42C', boss 42C will interfere with downward motion of arm 46. It will be appreciated that this prevents both arm 46 from moving downwardly and also prevents cam 52 and shaft 58 from being driven inwardly. Therefore, unthreading locking collar 12 will prevent circuit breaker 30 from being energized.

When plug 10 is inserted and secured by tightening collar 12 as illustrated in FIG. 4, the slider and its boss 42C move from phantom position 42C to the illustrated position. Accordingly, boss 42C is not aligned with step 46D so that interference will not occur. Therefore, power can be applied by thrusting handle 50 inwardly to slide shaft 58 and throw switch lever 64. This motion also drives cam 52 inwardly to drive pin 48 and arm 46 downward. This results in tab 46A grasping locking collar 12 from behind as shown in FIG. 2. Thus with a single stroke and with the use of only one hand, power is simultaneously applied while the plug 10 is captured.

It is to be appreciated that various modifications may be implemented with the respect to the above described preferred embodiments. For example, the dimensions and shapes of the various connections and housings can be altered depending upon the desired power rating, the number of conductors, humidity, immunity, keying, etc. Also, while a hook-like arm is shown for restraining the locking collar, in some embodiments other clamping devices may be used instead. Also while an embossed slider is shown clearing or interfering with a step in an arm, in some embodiments alternate structure can be used employing various keys, locks, etc. Also while the arm is shown pivoted to a wall mounted on the connector housing (ultimately supported by the frame), in some embodiments the pivoting may be achieved directly from the frame. Furthermore, while a cam slot is illustrated, in some embodiments, a cam surface can be used with a spring driving the cam follower against the surface.

Obviously, many modifications and variations of the present invention are possible in light of the above teachings. It is, therefore, to be understood that within the scope of the appended claims, the invention may be practiced otherwise than as specifically described.

What is claimed is:

1. A receptacle for receiving a plug having a locking collar comprising:

a frame;

an electrical connector mounted on said frame and having a locking means for engaging and holding said collar;

a switch means mounted on said frame, connected to said connector and operable to disconnect said connector; and a manually operable interlock means having an on and off position, said interlock means being supported on said frame for manually operating said switch means to apply power to said connector after the securing of said plug into said connector, said interlock means being positioned adjacent said connector and being responsive to the securing thereon of said collar, said interlock means being restrained from moving to said on position without said collar being secured to said locking means, said interlock means including:

grasping means extending beyond said locking means for grasping said plug on a rearward external surface of said collar and preventing disengagement from said locking means in response to said interlock means being placed in said on position.

2. A receptacle according to claim 1 wherein said grasping means comprises:

a pivotally mounted arm supported by said frame, said arm having a transverse tab sized to engage said rearward external surface of said plug.

3. A receptacle according to claim 2, wherein said interlock means comprises:

a slider mounted on said connector for sliding inwardly from a dead to a ready position in response to the securing of said plug into said connector, said slider in its dead position being positioned to prevent movement of said interlock means into said on position.

4. A receptacle according to claim 3 wherein said interlock means comprises:

a cam means coupled to said switch means and said arm for simultaneously operating said switch means and said arm, said cam means being operable to simultaneously close the switch means and drive said arm to a grasping position when said slider is in said ready position.

5. A receptacle according to claim 4 wherein said cam means comprises:

a handle having a cam slot, said arm including:

a cam follower extending into said cam slot from a position on said arm between said tab and the pivotal connection of said arm to said frame.

6. A receptacle according to claim 5 wherein said handle is mounted on said frame to allow longitudinal reciprocation, said cam slot diverging away from said handle for longitudinally outward positions.

7. A receptacle according to claim 2 wherein said plug has a threaded locking collar and wherein said tab is sized and positioned to grasp said collar from behind.

8. A receptacle according to claim 6 wherein said slider has an outwardly projecting boss and wherein said arm has a step on its underside, said boss being aligned with said step when said slide is in said dead position.

9. A receptacle according to claim 8 wherein said arm is pivotally mounted on the side of said connector, said connector having a channel into which said slider is mounted.

* * * * *